US009850673B1

(12) United States Patent
Hudlow

(10) Patent No.: US 9,850,673 B1
(45) Date of Patent: Dec. 26, 2017

(54) CABLE SYSTEM FOR A DISASTER-RESISTANT STRUCTURE AND METHOD FOR CONSTRUCTING CABLE SYSTEM

(71) Applicant: Jessie Edward Hudlow, Irving, TX (US)

(72) Inventor: Jessie Edward Hudlow, Irving, TX (US)

( * ) Notice: Subject to any disclaimer, the term of this patent is extended or adjusted under 35 U.S.C. 154(b) by 0 days.

(21) Appl. No.: 15/242,692

(22) Filed: Aug. 22, 2016

(51) Int. Cl.
*E04H 9/14* (2006.01)
*E04B 1/41* (2006.01)

(52) U.S. Cl.
CPC *E04H 9/14* (2013.01); *E04B 1/41* (2013.01)

(58) Field of Classification Search
CPC ..... E04H 9/14; E04B 1/3437; E04B 1/41
USPC ..... 52/23, DIG. 11, DIG. 12, 698
See application file for complete search history.

(56) References Cited

U.S. PATENT DOCUMENTS 4,472,916 A * 9/1984 Krebs ..... E04B 1/18 403/174
5,448,861 A * 9/1995 Lawson ..... E04H 9/14 52/223.13
5,491,935 A * 2/1996 Coxum ..... E04B 7/02 52/105
5,687,512 A * 11/1997 Spoozak ..... E04H 9/14 52/148
5,983,572 A * 11/1999 Laboy ..... E04B 7/02 52/167.1
6,161,339 A * 12/2000 Cornett, Sr. ..... E04B 7/02 52/223.13
6,219,973 B1 * 4/2001 Lafferty ..... E04B 7/02 52/23
6,415,558 B1 7/2002 Cherry
6,438,906 B1 8/2002 Komarowski
6,532,710 B2 3/2003 Terry
6,843,027 B2 * 1/2005 Gaddie ..... E04B 1/26 52/223.1
7,237,362 B2 7/2007 Bishop
7,484,334 B1 * 2/2009 Oviedo-Reyes ..... E04H 9/14 52/23
8,272,171 B2 * 9/2012 Curry, III ..... E04H 9/14 52/23
8,646,225 B2 2/2014 Wirtz
8,984,831 B1 3/2015 West
9,109,340 B1 * 8/2015 Linn, Jr. ..... E02D 5/223
2001/0037611 A1 * 11/2001 Cornett, Sr. ..... E04B 7/02 52/23

(Continued)

OTHER PUBLICATIONS

FEMA, Taking Shelter from the Storm, Building a Safe Room for Your Home or Small Business, FEMAP-320, 4th Ed. Dec. 2014.

(Continued)

*Primary Examiner* — Adriana Figueroa
(74) *Attorney, Agent, or Firm* — Michael J. Spivey

(57) ABSTRACT

The present invention is a novel cable system for a disaster-resistant structure (such as a building or wall) and a method for constructing or assembling the cable system to secure the structure, including the roof of the structure, to a body of cast material such as a foundation, grade beam, base, platform, slab or floor by incorporating flexible cables to resist the very high loads that may occur due to high winds, tornadoes, earthquakes, or other severe storms.

6 Claims, 4 Drawing Sheets

(56) References Cited

U.S. PATENT DOCUMENTS

| | | | | |
|---|---|---|---|---|
| 2005/0193681 | A1* | 9/2005 | Brackett | E04H 9/028 52/698 |
| 2015/0082714 | A1 | 3/2015 | Guion | |

OTHER PUBLICATIONS

FEMA, Safe Rooms for Tornadoes and Hurricanes Guidance for Community and Residential Safe Rooms, FEMA p. 361, 3rd Ed, Mar. 2015.

* cited by examiner

CABLE SYSTEM FOR A DISASTER-RESISTANT STRUCTURE AND METHOD FOR CONSTRUCTING CABLE SYSTEM

The present invention is a novel cable system for a disaster-resistant structure (such as a building or wall) and a method for constructing or assembling the cable system to secure the structure, including the roof of the structure, to a body of cast material such as a foundation, grade beam, base, platform, slab or floor by incorporating flexible cables to resist the very high loads that may occur due to high winds, tornadoes, earthquakes, or other severe storms. The structure is secured to the body of cast material by at least one flexible cable. The flexible cable can be comprised of any member from a group of cables, wires, ropes, strings, or threads. The flexible cable can also be made from a wide range of materials including steel, other metals, nylon, manila, polypropylene, polyester, polyethylene, Kevlar, Nomex or polyimides. Typical construction methods for a body of cast material include building a form work or frame that defines the shape and dimensions of the body of cast material. In the preferred embodiment of the present invention, at least one hollow tube is placed into the area defined by the form work or frame for the body of cast material. When the cast material is placed into the form work or frame and hardens, the tube is partially embedded. In the best mode, the portion of the tube extending out of the body of cast material is then cut off, leaving hollow pathways formed by the tube into and out of the body of cast material so that the flexible cable can be passed inside the tubes. The tube may also be woven between the conventional steel reinforcing of the body of cast material. The distinctive feature of the preferred embodiment of the present invention is the use of flexible cable to secure the roof structure directly to the body of cast material rather than the conventional approach of using only straps and nails to secure the roof structure to the walls of a house or building. Specifically, the flexible cable provides the advantage of securing the roof decking and the roof rafters to the foundation rather than relying only on the connections of the roof rafters to the top plates as well as the wall studs to the bottom plates.

In the preferred embodiment, the end of a flexible cable is connected to either a roof member (the rafters or roof beams or ridge beams) or other structural member, to the foundation itself, then passed through the hollow tube in the foundation and looped up in a substantially vertical plane traveling either inside the framed walls or in the gap between the framed walls and the brick veneer, passing over one or more roof members (the rafters or roof beams or ridge beams) and back down to be passed through another embedded tube in the foundation, up again, and so forth along the length of each wall. The other end of the flexible cable is then connected to a roof rafter, or other structural member, or to the foundation, or to another flexible cable.

The cable connections can be accomplished by using a clamp, or clamps, sleeves, clips, crimps, turnbuckles, hooks, ball and strap fittings, strap forks, ball and shanks, threaded fittings, strap eyes, eyelet fittings, eye bolts, plugs, threaded plugs, ball end plugs, ties, welds or any other means for connecting cable ends. The flexible cables provide the strength to secure the entire structure including the roof of the structure to the body of cast material.

FIELD OF THE INVENTION

The present invention is a novel cable system for a disaster-resistant structure and a method for assembling or constructing the cable system to secure a structure to a body of cast material, that incorporates flexible cable to secure and reinforce the structure or a structural member, such as a building, wall or a roof to a body of cast material such as a foundation, grade beam, base, platform, floor, or slab, to resist the very high loads, upward loads, or impact of debris and other hazards that may occur due to high winds, tornadoes, earthquakes, or other severe storms.

Background of Securing Methods:

If objects such as the walls of a framed building are to be secured to a body of cast material the process is often accomplished by embedding a steel rod with the threaded end protruding in order to receive the object to be secured. If the body of cast material is already installed and in a solid state with no rods or bolts protruding to receive a second cast body or object, then typically holes are drilled in the body of cast material and rods or bolts are installed.

The conventional approach for securing a roof structure to the walls of a structure such as a house is to use straps and nails. Walls are often secured to the foundation by using J-bolts, screws, nails or straps. While these conventional methods provide reasonable resistance to ordinary lateral forces and some resistance to upward forces, they are not able to resist the very high loads, upward loads, or impact of debris and other hazards that may occur due to high winds, tornadoes, earthquakes, or other severe storms.

BACKGROUND OF THE INVENTION

There is a growing desire to improve the disaster resistance of buildings used as homes and businesses. A determining factor in the resistance of a structure to rare and very high externally-imposed side loads and upward loads is the effectiveness of the connection of the building walls to the ground and the connection of the building roof to the building walls. In most cases a sturdy concrete foundation or grade beam is already in place and is used for the normal function of the building. A conventional foundation is designed to provide a stable and flat surface to resist the downward loads such as the weight of the building and all the contents of the building. Embedded J-bolts that are typically used to connect the wood frame walls to the concrete foundation provide reasonable resistance to ordinary lateral forces and some resistance to upward forces. However, in resisting any significant upward loads, these bolts are limited by the strength of the wood that they are bolted through. Disaster loading often includes upward forces and impact forces that exceed by a very large margin the capacity of standard wall anchoring. The conventional method of increasing resistance to upward forces on the roof is to install metal straps with nails on the roof rafters. A system is needed that is able to secure the roof structure to the foundation with structural components that are not only strong enough to resist the disaster forces, but that are at the same time able to better distribute these forces into the foundation and across the structural components of the building walls and roof so that localized structural failure is substantially reduced. The flexible cable loops used in the present invention provide a superior function over conventional methods by holding the roof and the walls in place even if a portion of a wall is damaged by severe impact damage.

BRIEF DESCRIPTION OF DRAWINGS

The novel features of the embodiments of the present invention are set forth in the appended claims. However, the embodiments themselves, as well as a preferred embodiment, and further objectives and advantages thereof, will best be understood by reference to the following detailed description when read in conjunction with the accompanying drawings, wherein:

Figure 1:
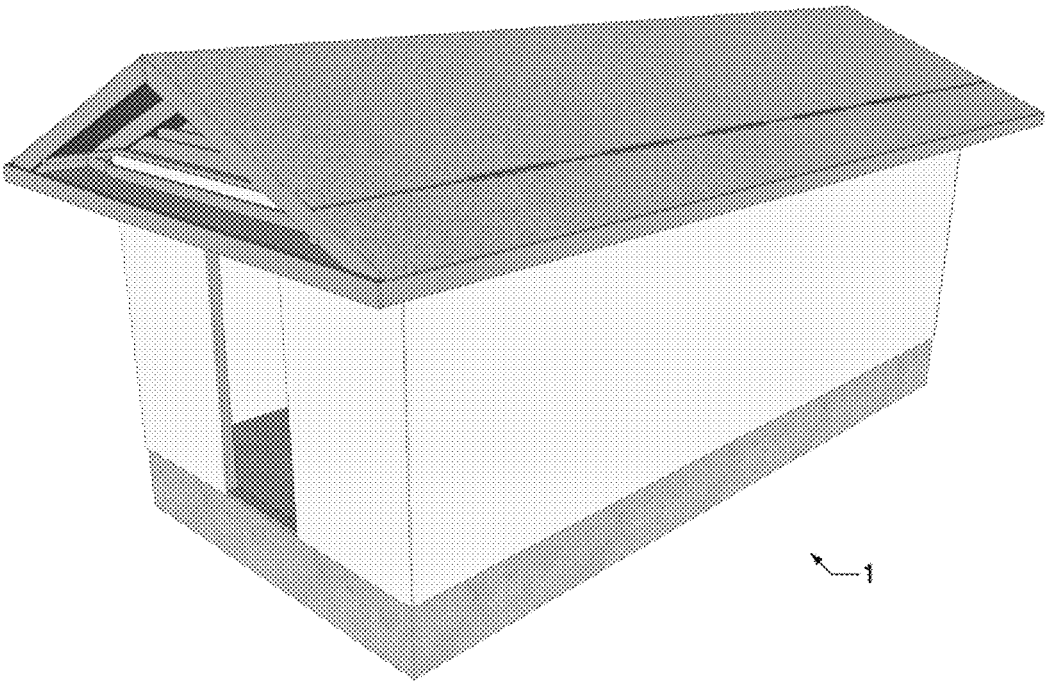
FIG. 1 is an oblique, three-dimensional drawing of a house as it might appear in another preferred embodiment of the present invention.

While the construction method and assembly process can accommodate various modifications and alternative forms, specific embodiments thereof have been shown by way of an example of a fortified house in the drawings and are herein described in detail. The invention as set forth in the provided claims is not limited by the embodiments presented, and may be embodied in various other forms and applications and remain within the spirit and scope of this disclosure.

DESCRIPTION OF THE INVENTION/PREFERRED EMBODIMENT

Figure 2:
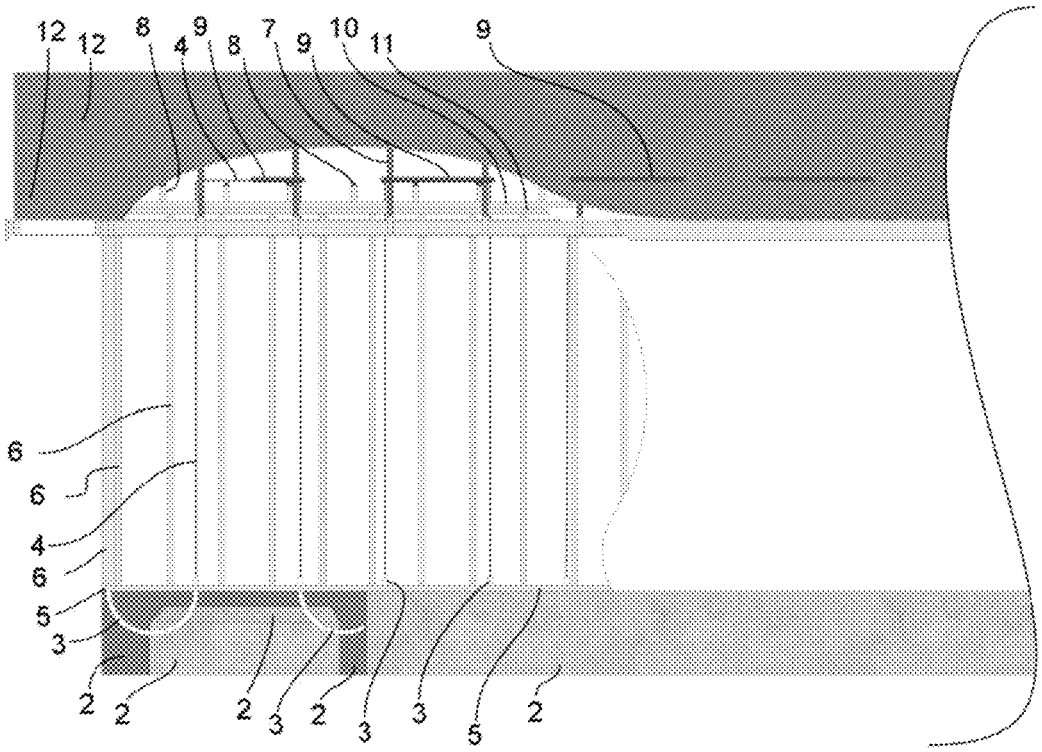
FIG. 2 is a partially cut-away view of FIG. 1, depicting most of the components of the present invention's securing system, and assembly process.

The present invention applies to any structure (such as a building or wall) for the purpose of making it disaster-resistant. The preferred embodiment of the present invention is a cable system for an entire free-standing structure such as a wood or metal frame house, which secures the structure by vertically looping flexible cable within or on the outside of each wall, from the foundation beneath the wall up to the roof rafters at the top of the wall and back down again to the foundation in a series of loops along the plane of each wall, thus securing, wall by wall, the entire perimeter of the roof structure to the foundation. FIG. 1 illustrates such a fortified house (1). FIG. 2 provides a partially cut-away view of FIG. 1 to show the components of the roof-secured structure (1), including a foundational body of cast material (2), embedded tubes (3), flexible cables (4), bottom plate (5), wood wall stud (6), roof rafter (7), ceiling joist (8), flexible cable channel (9), upper top plate (10), lower top plate (11), and roof deck (12). This preferred embodiment of a whole house or building may be envisioned as follows:

Referring to FIG. 2, a conventional foundation (2) is installed with the added feature of embedded tubes (3) within the foundation (2) along the perimeter area where the outside wall forms will be erected. The embedded tubes (3) may be formed to take a path around the steel bars in the foundation, adding "pull-out" strength to achieve better resistance to upward forces.

Figure 3:
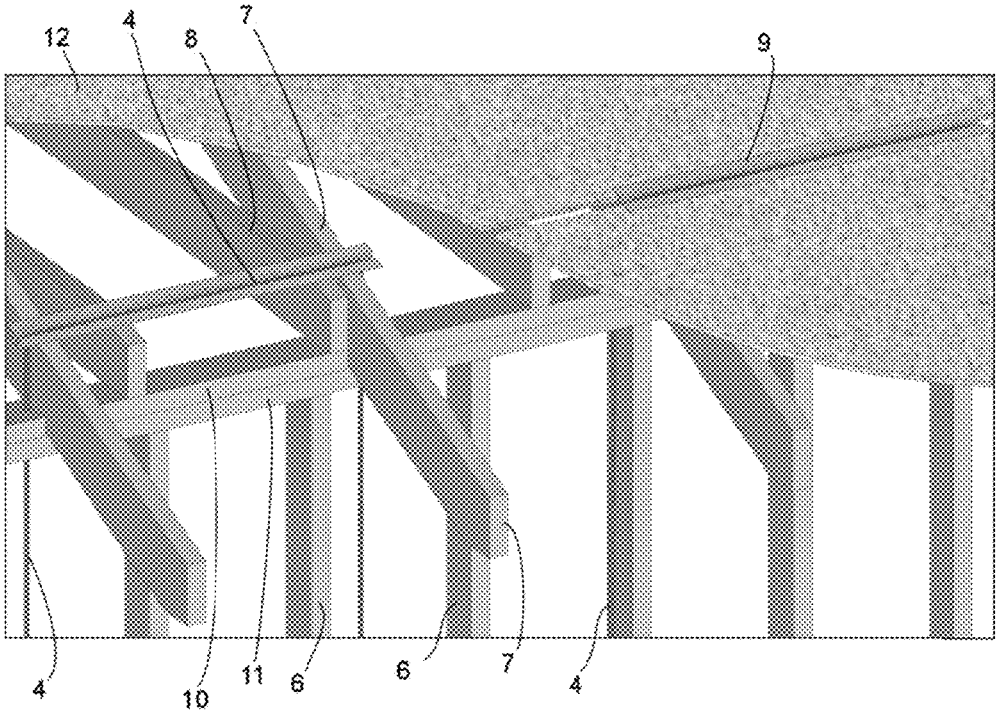
FIG. 3 is magnified view of FIG. 2, showing a flexible cable installed into the flexible cable channel as it passes over the roof rafters.

Referring to FIG. 2 and FIG. 3, conventional framing is installed, including members such as bottom plates (5), wood wall studs (6), top plates (10, 11), roof rafters (7), ceiling joists (8) and roof decking (12).

Referring to FIG. 3, the roof decking (12) is installed with a narrow gap in the decking above each wall. Strips of specialized flexible cable channel (9) are installed in the gap, bridging one or more roof rafters (7). For houses or buildings with gables, the end rafters above the gabled walls are prepared with holes drilled along their spans or other accommodations to facilitate the looping of the flexible cables (4) through or over the rafters (7) at the top of the gabled walls.

Figure 4:
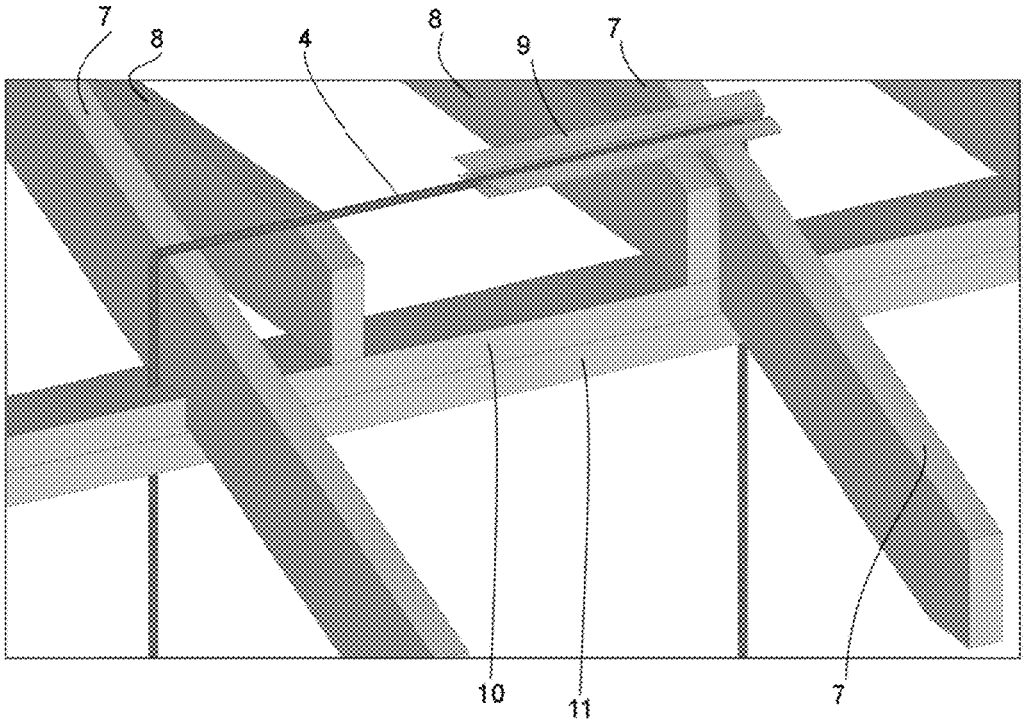
FIG. 4 is also magnified view of FIG. 2, showing a flexible cable installed into the flexible cable channel that is shown in a cut-away view.

Referring to FIG. 2 and FIG. 4, the end of a flexible cable (4) is connected to either a roof rafter (7) or to the foundation itself (2), then passed through the embedded tube in the foundation and looped up in the plane of the wall to the roof, where it is run through the strip of flexible cable channel (9), passing over the included rafter or rafters and back down to be passed through another embedded tube (3) in the foundation (2), up again, and so forth along the length of each wall. The other end of the flexible cable (4) is then connected to a roof rafter (7), or to the foundation (2), or to another flexible cable (4). For a gabled wall, the flexible cable is run up and down along the wall in the same manner, except that the cable is passed in and out of holes drilled along the rafter at the top of the wall rather than through the strips of specialized cable channel (9). If a ridge beam or ridge board is included in the gabled wall, the ridge beam or board should be included in one of the looped cables (4).

For wood frame structures, the flexible cable (4) is passed up and down within the wall frame between the wall studs (6) and through holes drilled in the top plates (10, 11) (see FIG. 4). Brick veneer buildings allow for the cable loops to be positioned on the outside of the walls, in the space between the framed wall and the brick veneer. In this case, the cable may be looped in diagonal paths (for added strength) on the outside of the wall before the brick veneer is installed.

Referring to FIG. 2 and FIG. 3, the distinctive feature of the present invention as shown in this preferred embodiment is the use of flexible cable (4) to secure the roof structure to the concrete slab foundation (2) rather than the conventional approach of using straps and nails to secure the roof structure to the walls of a house or building. Specifically, the flexible cable (4) provides the advantage of securing the roof decking (12) and the roof rafters (7) to the foundation (2) rather than only relying on the connections of the roof rafters (7) to the top plates (10, 11), as well as the wall studs (6) to the bottom plates (5).

What is claimed is:

1. A cable system for securing a building structure comprising a body of cast material, at least one wall and at least one roof secured to the body of cast material, which comprises:

(a) at least one flexible cable having two ends, wherein the flexible cable is selected from the group consisting of cables, wires, ropes, strings, or threads and further comprising steel, nylon, manila, polypropylene, polyester, polyethylene, Kevlar, Nomex or polyimides, wherein the flexible cable forms a loop or a series of loops in a substantially vertical plane so that the flexible cable travels upward toward the at least one roof, over at least one roof rafter, downward toward the body of cast material, is connected to the body of cast material, then travels upward again toward the at least one roof and continuing in that pattern for the length of the at least one wall, the two ends of the flexible cable are connected to each other or to the structure's framework or to the body of cast material;

(b) at least one connector comprised of clamps, sleeves, clips, turnbuckles, hooks, ball and strap fittings, strap forks, ball and shanks, threaded fittings, strap eyes, eyelet fittings, eyebolts, plugs, threaded plugs, ball end plugs, or ties are used to connect the two ends of the flexible cable; and (c) at least one tube, partially embedded in the body of cast material and selected from the group consisting of plastics, metals, cloth or composites, wherein the at least one flexible cable is passed through the at least one tube.

2. The cable system of claim 1, further comprising at least one channel that spans at least one roof rafter and selected from the group consisting of metals, plastics, polyethylene or composite, wherein the at least one flexible cable is looped over the at least one channel.

3. A cable system for securing a building structure comprising a body of cast material, at least one wall and at least one roof secured to the body of cast material, which comprises:

(a) at least one tube, partially embedded in the body of cast material and selected from the group consisting of plastics, metals, cloth, polyethylene or composite;

(b) at least one channel that spans at least one roof rafter and selected from the group consisting of metals, plastics, polyethylene or composite;

(c) at least one flexible cable having two ends, wherein the flexible cable is selected from the group consisting of cables, wires, ropes, strings, or threads and further comprising steel, nylon, manila, polypropylene, polyester, polyethylene, Kevlar, Nomex or polyimides, wherein the flexible cable forms a loop or a series of loops in a substantially vertical plane so that the flexible cable travels upward toward the at least one roof, over the at least one channel, downward toward the body of cast material, within the at least one tube, then upward toward the at least one roof and continuing in that pattern for the length of the at least one wall, the two ends of the flexible cable are connected to each other or to the structure's framework or to the body of cast material; and (d) at least one connector comprised of clamps, sleeves, clips, turnbuckles, hooks, ball and strap fittings, strap forks, ball and shanks, threaded fittings, strap eyes, eyelet fittings, plugs, threaded plugs, ball end plugs, or ties used to connect the two ends of the flexible cable.

4. A method for securing a building structure comprising a body of cast material, at least one wall and at least one roof secured to the body of cast material, which comprises:

(a) installing the body of cast material and a framework for the structure;

(b) placing at least one tube within the body of cast material so that the at least one tube is at least partially embedded in the body of cast material;

(c) passing the at least one flexible cable through the at least one tube;

(d) looping at least one flexible cable in a substantially vertical plane so that the flexible cable travels upward toward the at least one roof, over at least one roof rafter, downward toward the body of cast material, is connected to the body of cast material, then travels upward again toward the at least one roof;

(e) repeating the looping step until the at least one flexible cable forms a series of loops spanning the entire length of the at least one wall; and (f connecting the two ends of the at least one flexible cable to each other or to the structure's framing or to the body of cast material.

5. The method of claim 4, further comprising installing at least one channel that spans at least one roof rafter and said channel is selected from the group consisting of metals, plastics, polyethylene or composite and looping the at least one flexible cable over the at least one channel.

6. A method for securing a building structure comprising a body of cast material, at least one wall and at least one roof secured to the body of cast material, which comprises:

(a) placing at least one tube within the body of cast material so that the at least one tube is at least partially embedded in the body of cast material;

(b) installing the body of cast material;

(c) installing a framework for the structure;

(d) installing at least one channel that spans at least one roof rafter and said channel is selected from the group consisting of metals, plastics, polyethylene or composite;

(e) passing at least one flexible cable having two ends through the at least one tube;

(f) looping the at least one flexible cable in a substantially vertical plane upward toward the at least one roof, over the at least one channel, downward toward the body of cast material;

(g) repeating the passing and looping steps until the at least one flexible cable is a series of loops spanning the entire length of the at least one wall; and (h) connecting the two ends of the at least one flexible cable to each other or to the structure's framing or to the body of cast material.

* * * * *